US007337728B2

(12) United States Patent
Shabram, Jr. et al.

(10) Patent No.: US 7,337,728 B2
(45) **Date of Patent: *Mar. 4, 2008**

(54) COLLAPSIBLE FOLDING ARTICLE OF FURNITURE

(76) Inventors: Lyle F. Shabram, Jr., 71 Rancho Rd., Carmel Valley, CA (US) 93924; Patrict L. Shabram, 1486 Majestic La., Brentwood, CA (US) 94513

( * ) Notice: Subject to any disclaimer, the term of this patent is extended or adjusted under 35 U.S.C. 154(b) by 30 days.

This patent is subject to a terminal disclaimer.

(21) Appl. No.: 10/914,869

(22) Filed: Aug. 9, 2004

(65) Prior Publication Data

US 2005/0072340 A1 Apr. 7, 2005

Related U.S. Application Data

(63) Continuation-in-part of application No. 10/267,182, filed on Oct. 8, 2002, now Pat. No. 6,779,466.

(60) Provisional application No. 60/328,126, filed on Oct. 9, 2001.

(51) Int. Cl.
*A47B 3/00* (2006.01)

(52) U.S. Cl. ..... 108/35; 108/115; 108/38

(58) Field of Classification Search ..... 108/35, 108/115, 38, 36, 33, 34, 41, 118, 120
See application file for complete search history.

(56) References Cited

U.S. PATENT DOCUMENTS 1,846,607 A * 2/1932 Nicholas ..... 108/36
2,388,192 A * 10/1945 Stechbart ..... 108/35
2,565,187 A 8/1951 Udell
2,903,311 A * 9/1959 Earhart ..... 108/34
2,967,037 A * 1/1961 Christle ..... 108/35
3,000,683 A * 9/1961 Macneary ..... 108/33
3,110,476 A * 11/1963 Farris ..... 108/35
3,861,328 A * 1/1975 Lawless ..... 108/115
4,389,946 A 6/1983 Hwang
5,535,683 A 7/1996 Novak
6,779,466 B2 * 8/2004 Shabram, Jr. ..... 108/35

* cited by examiner

*Primary Examiner*—Jose V. Chen
(74) *Attorney, Agent, or Firm*—Eric Hanscom

(57) ABSTRACT

A collapsible folding article of furniture, including a top member forming a generally planar top support surface, a bottom member forming a base, and a plurality of foldable leg assemblies each including a set of at least two elongated leg sections pivotally attached together at adjacent ends by a hinge allowing the leg sections to be rotated between a folded configuration and an extended configuration, each of the hinges having a first part attached to one of the leg sections and a second part attached to the other one of the leg sections, the first and second parts being pivotally secured together and having associated therewith a spring loaded detent for lockingly engaging detent receiving apertures, formed in the first and second parts, when the leg assembly is in its extended configuration, one end of each leg assembly being pivotally attached to the top member and an opposing end of each leg assembly being pivotally attached to the base member, the leg assemblies allowing the top member to be collapsed from a deployed position remote from the bottom member to a retracted position proximate the bottom member.

17 Claims, 12 Drawing Sheets

FIG. 1
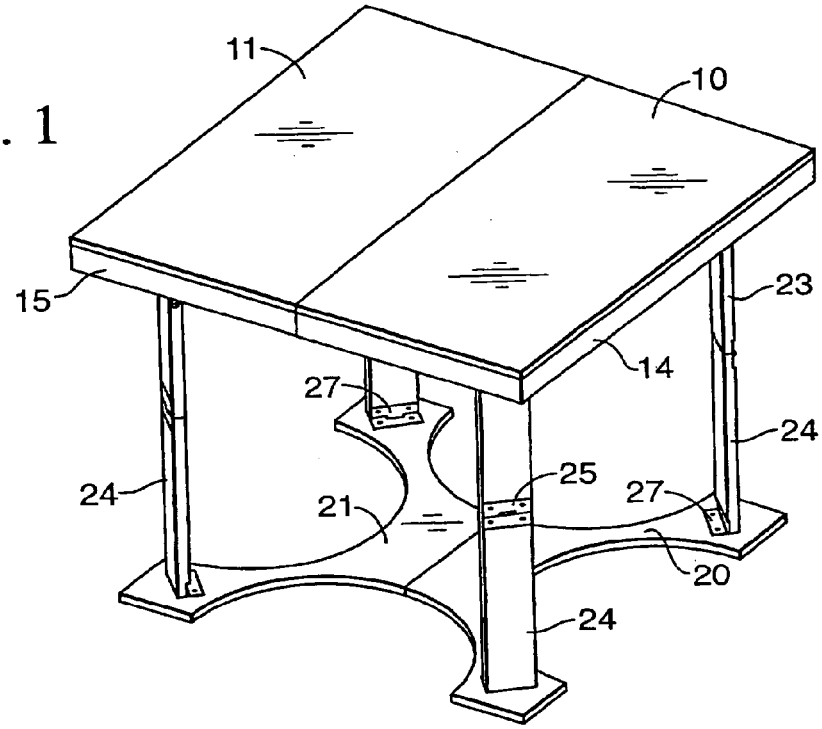
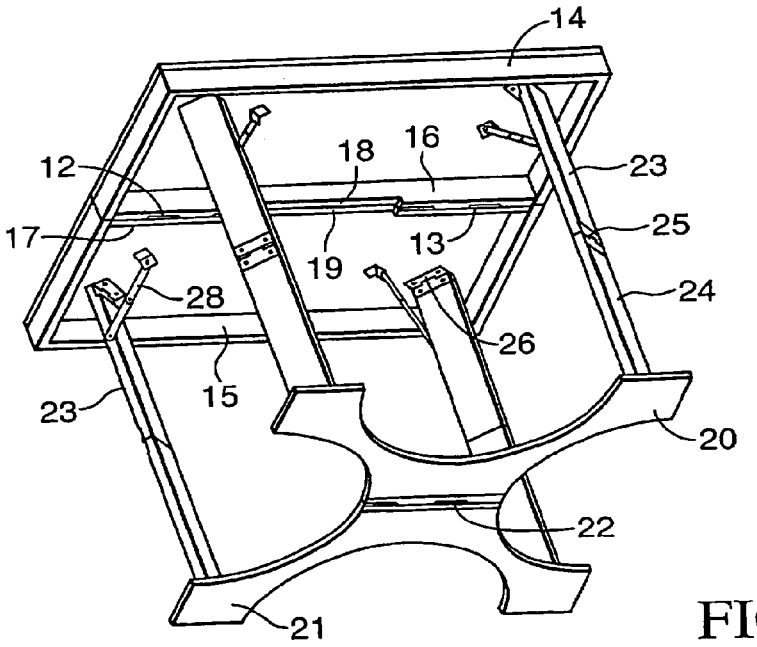
FIG. 2

COLLAPSIBLE FOLDING ARTICLE OF FURNITURE

RELATED APPLICATIONS

The present application is a continuation-in-part of U.S. patent application Ser. No. 10/267,182 filed Oct. 8, 2002, now U.S. Pat. No. 6,779,466 entitled COLLAPSIBLE PORTABLE FOLDING TABLE WITH FOLDING LEGS, and is related to and claims priority from U.S. Provisional Application Ser. No. 60/328,126, filed Oct. 9, 2001, and entitled COLLAPSIBLE PORTABLE FOLDING TABLE WITH FOLDING LEGS, the entire applications being expressly incorporated herein by reference.

BACKGROUND OF THE INVENTION

1. Field of the Invention

This invention relates to portable tables, such as card tables, camping tables, picnic tables and portable display tables that may be folded and compacted for storage or transportability. More particularly, the invention relates to a portable table that can be folded into a self-contained package that can be easily carried and stored in compact storage compartments such as those found in recreational vehicles, airplanes or small living areas.

2. Prior Art

The most common types of portable or temporary tables are generally known as card tables. The legs of a card table and similar folding leg tables generally hinge or connect to the underside of the table in a manner allowing the legs to pivot inward along one respective edge of the table to reduce the table to a substantially flat configuration essentially defined by the table top. Numerous other commonly known folding table leg configurations have been devised and used for years. Some table designs, such as the familiar ping pong table for example, combine a folding table top with folding legs. A few less commonly known tables also employ folding legs. For instance, U.S. Pat. No. 2,565,187 discloses a version of a collapsing table wherein the folding leg members pivotally connect to the table top and a base. The folding leg then allows the table to collapse vertically. U.S. Pat. No. 3,000,683 discloses a collapsible typing table having legs that fold up into a carry box for a typewriter. U.S. Pat. No. 4,389,946 discloses a stool or table of similar workings. And U.S. Pat. No. 5,535,683 discloses a carrying case convertible to a table with folding legs.

Most folding leg tables include some form of moveable or collapsible brace such as a folding scissor brace to help stabilize the table leg. The most compact portable table would require the folding of both the table top and folding or telescoping the table legs, but such a configuration poses some engineering design and stability problems, as well as problems with ease of set up.

SUMMARY OF THE INVENTION

It is therefore an object of this invention is to provide an article of furniture that may be easily converted from a compact portable state to a stable, sturdy table, bench or chair by simply raising the top and allowing the leg assembly to fall into position or where the top is foldable, by opening the top and allowing the leg assembly to fall into position.

It is also an object of this invention to provide a folding portable table or bench with foldable legs and a top that compacts with the folded legs enclosed within the side frame of the top.

Another object of this invention is to provide a folding portable table or bench which includes a top portion, folding legs and a base unit where the folding legs are pivotally attached or hinged at one end to the underside of the top and the at the other end hinged to the opposing surface of the base unit.

Furthermore it is an object of this invention to provide a folding portable table or bench with a top which includes a framework around the underside thereof, folding table legs, and a base unit wherein in the folded compact state the folded legs and base unit are enclosed by the perimeter frame of the top framework in a manner resembling a carry case or suitcase.

It is also an object of this invention to provide a collapsible table or bench with folding legs and a base that, when folded, are contained within a carry case-like enclosure formed by the top and frame, wherein the interior of the enclosure provides storage space for accessories such as a table cover, and wherein the case may be equipped with carry handles and closure latches.

Finally it is an object of this invention to provide a folding portable table stool or bench, display gaming table, outdoor table or similar furniture that includes a table top, foldable legs, a base unit, and means of hinging and bracing the legs with respect to each section of each leg, the top and base unit.

Briefly, a presently preferred embodiment of the present invention includes a top member forming a generally planar top support surface, a bottom member forming a base, and a plurality of foldable leg assemblies. Each leg assembly includes a set of at least two elongated leg sections pivotally attached together at adjacent ends by a hinge allowing the leg sections to be rotated between a folded configuration and an extended configuration. Each of the hinges has a first part attached to one of the leg sections and a second part attached to the other one of the leg sections. The first and second parts are pivotally secured together and have associated therewith a spring loaded detent for lockingly engaging detent receiving apertures formed in the first and second parts when the leg assembly is in its extended configuration. One end of each leg assembly is pivotally attached to the top member and an opposing end of each leg assembly pivotally attached to the base member such that the leg assemblies allow the top member to be collapsed from a deployed position remote from the bottom member to a retracted position proximate the bottom member.

Among the advantages of the present invention is that it provides a self contained, fully functional table seating unit that can be easily transported and/or stored without the use of any additional container or housing.

Another advantage of the present invention is that it provides a compact table or bench assembly that can be unpacked by merely lifting the top up from the base until the leg assemblies have been fully extended.

These and other objects and advantages of the present invention will no doubt become apparent to those skilled in the art after having read the following detailed description of the several embodiments illustrated in the several figures of the drawing.

BRIEF DESCRIPTION OF THE DRAWING FIGURES

FIG. 1 is a perspective overview of an open table made in accordance with the present invention;

FIG. 2 is a perspective underview of the open table of FIG. 1;

Figure 3A:
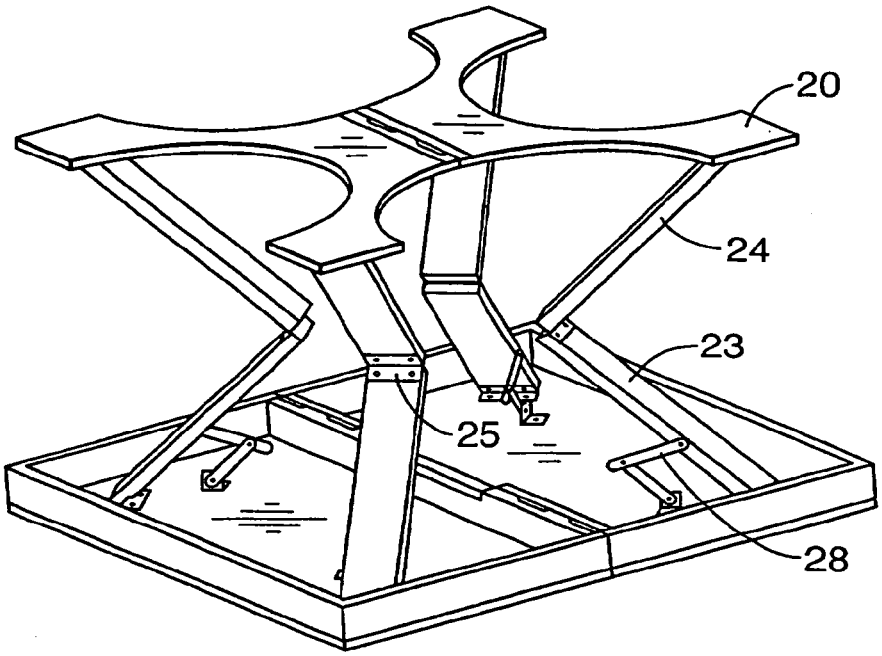
Figure 3B:
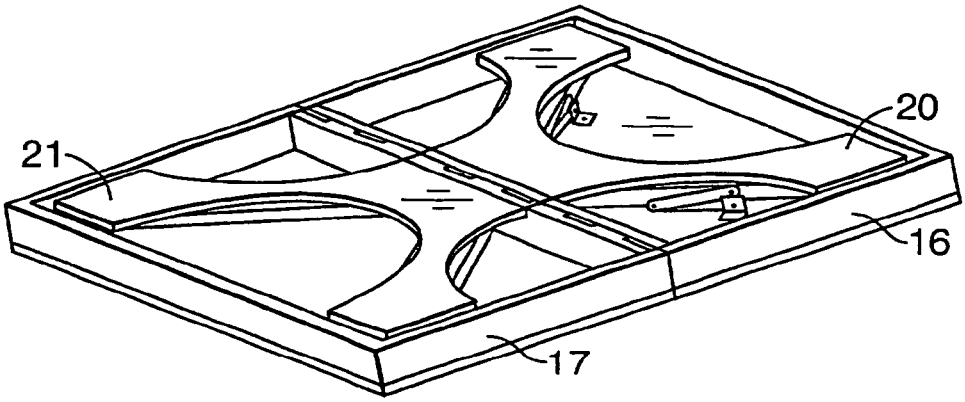
Figure 3C:
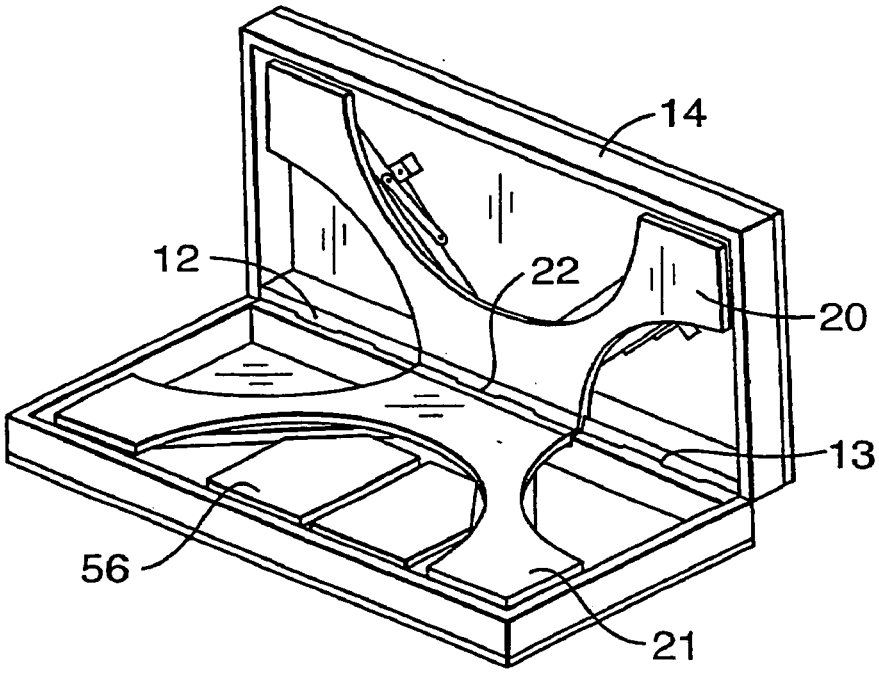
Figure 3D:
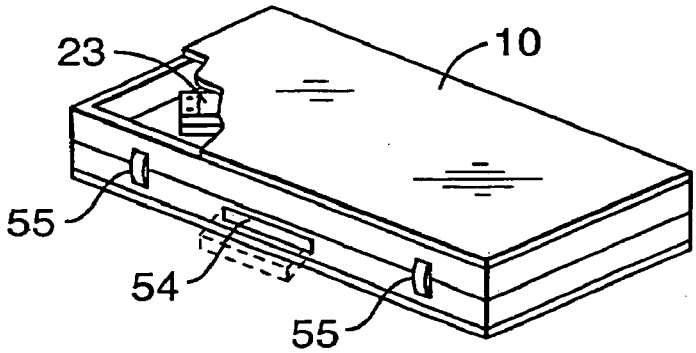
Figure 4A:
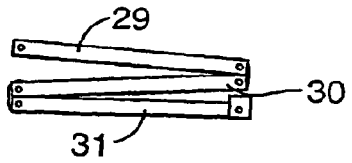
Figure 4B:
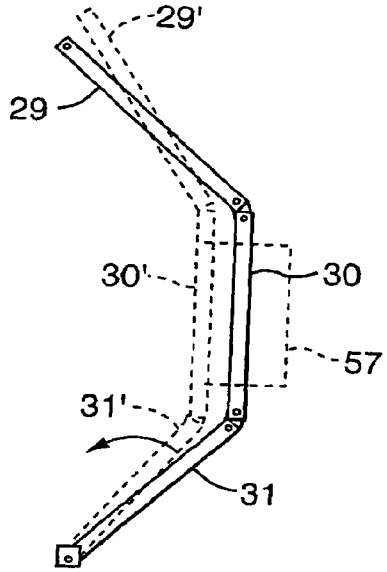
Figure 5A:
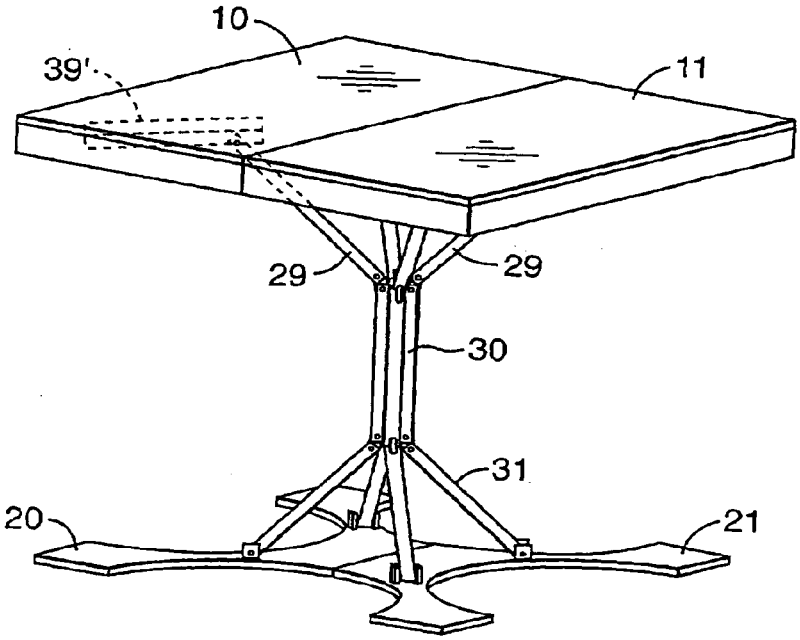
Figure 5B:
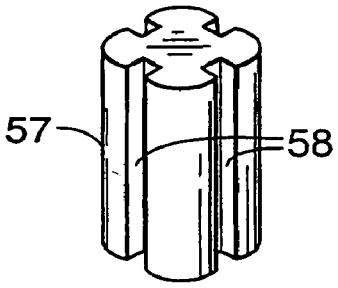
Figure 5C:
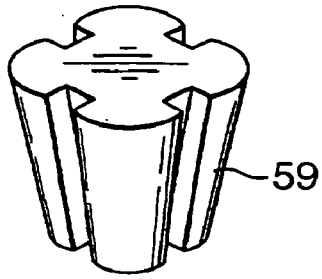

FIGS. 3*a* through 3*d* are four perspective views of the table in various stages of collapsing and folding. A cut away section in FIG. 3*d* provides exposure to part of a folded leg;

FIGS. 4*a* and 4*b* show one alternative configuration of a folding leg in the folded and extended configurations;

FIG. 5*a* is a perspective view showing an alternative embodiment of the table of the present invention including cylindrically tubular bi-folding legs;

FIGS. 5*b* and 5*c* illustrate slotted cylindrical and frusto-conical inserts for placement between the legs shown in FIG. 5*a*.

Figure 5D:
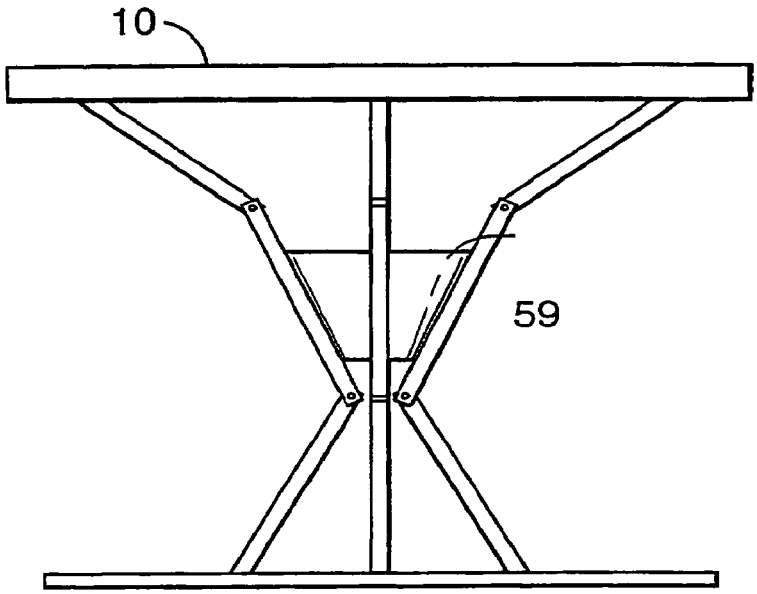

FIG. 5*d* is a side elevation of the table of FIG. 5*a* showing the insert of FIG. 5*c;*

Figure 6A:
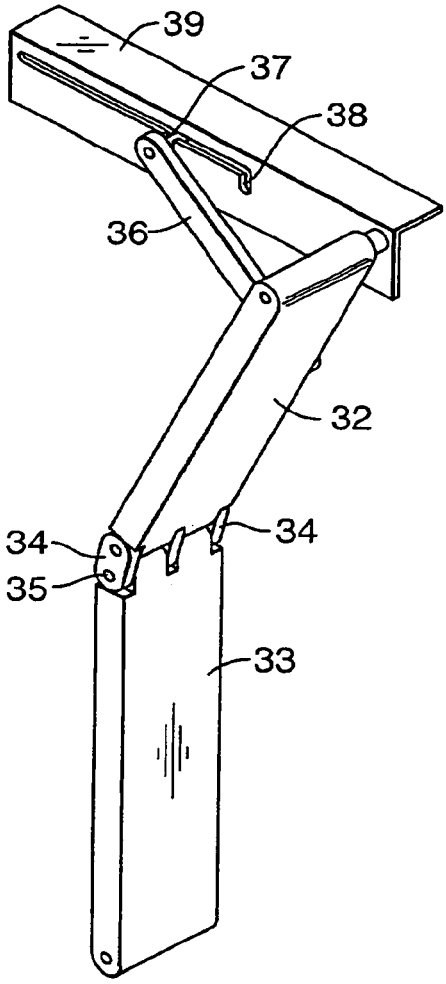
Figure 6B:
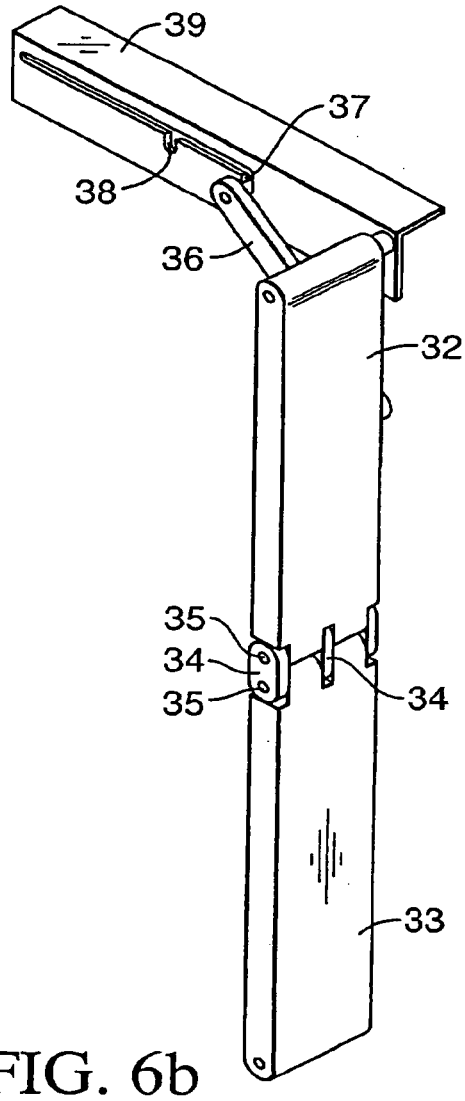
Figure 7A:
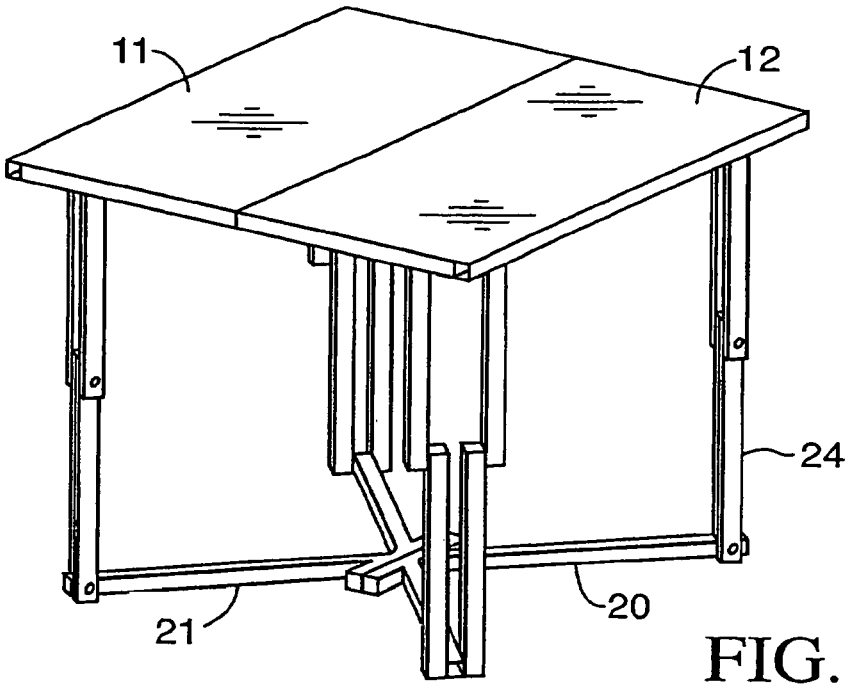
Figure 7B:
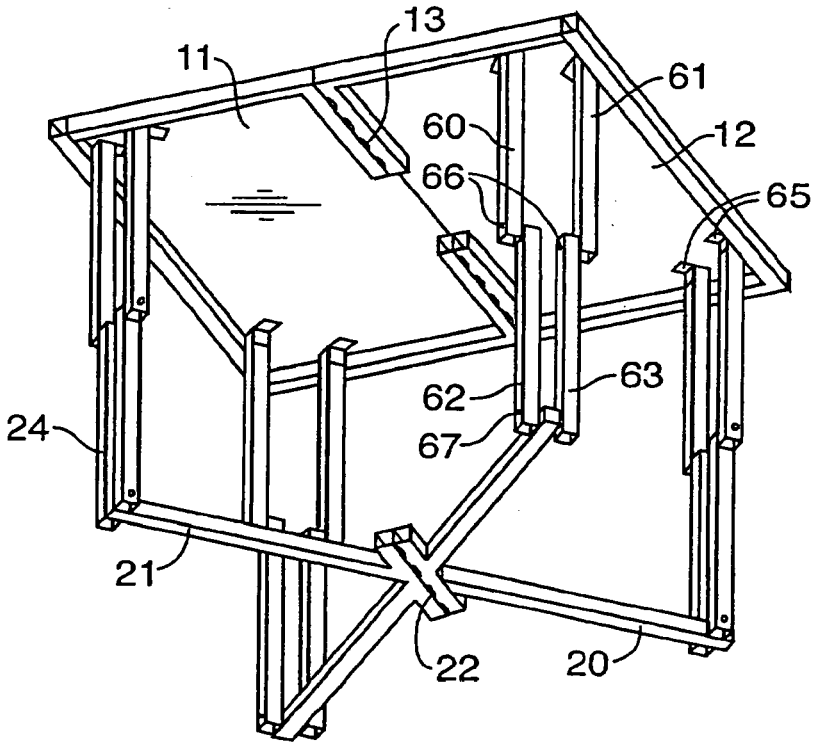
Figure 8A:
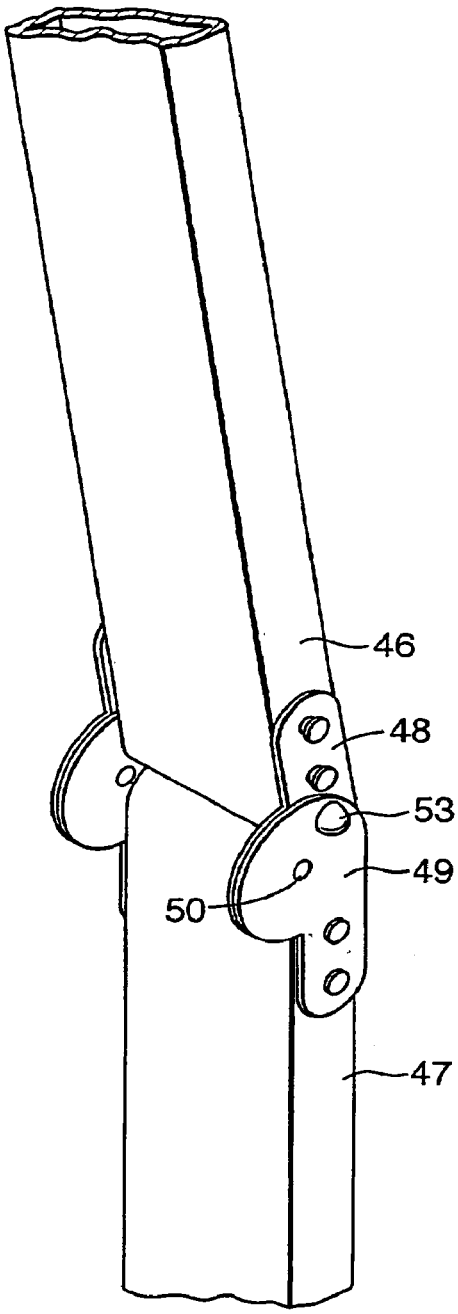
Figure 9:
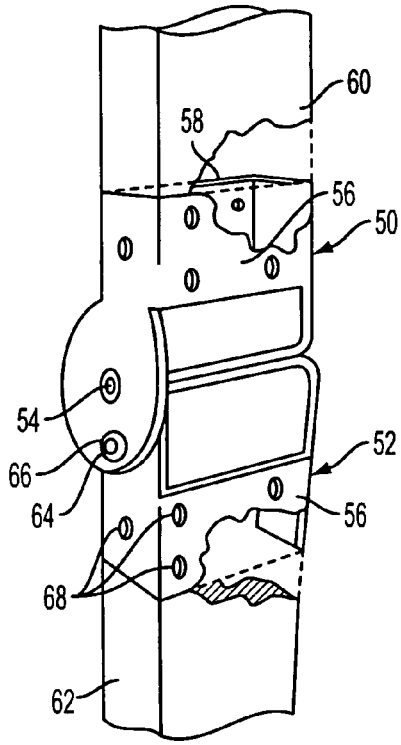
Figure 10:
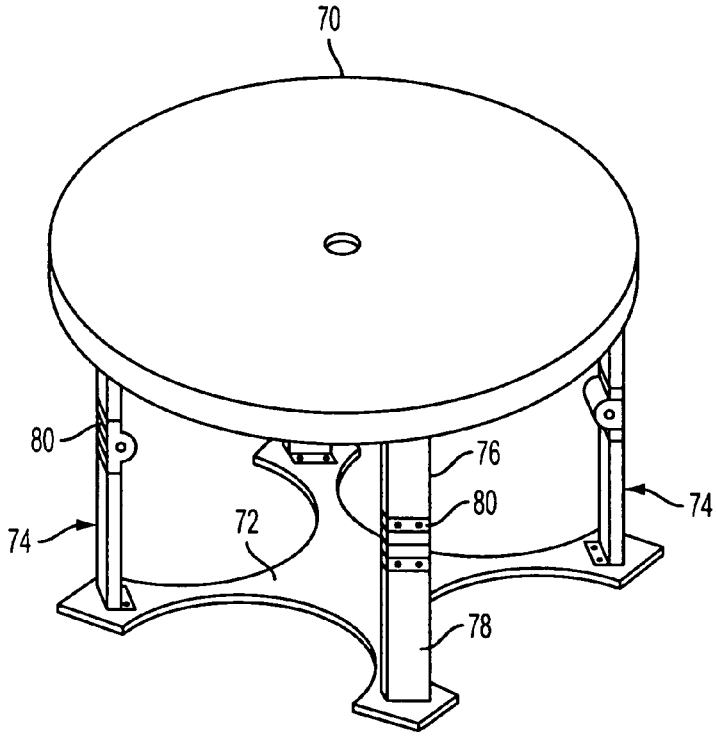
Figure 13:
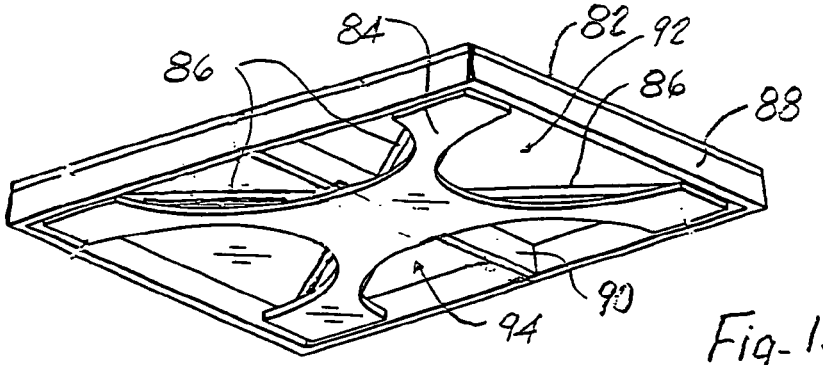
Figure 12:
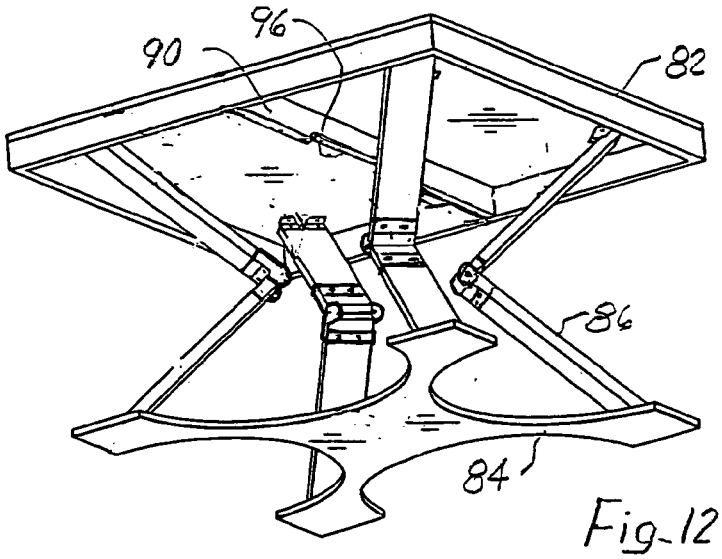
Figure 11:
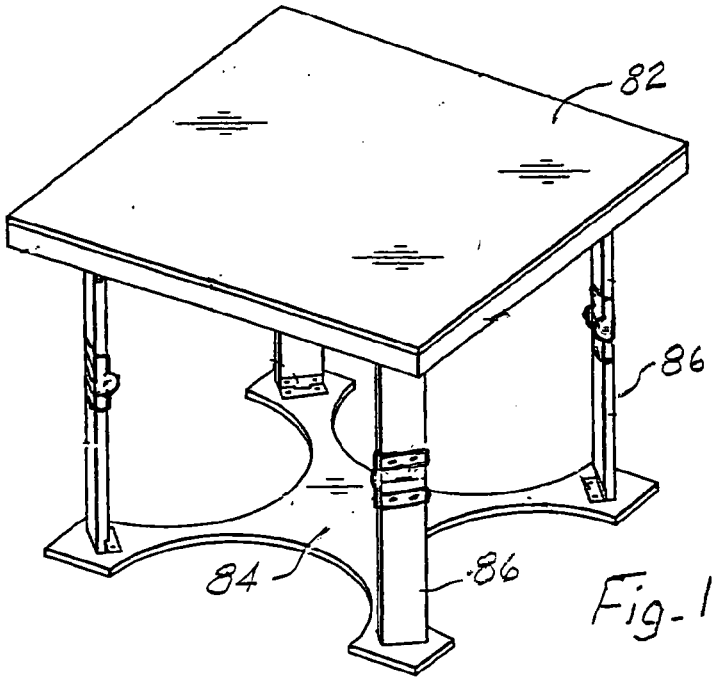
Figure 14:
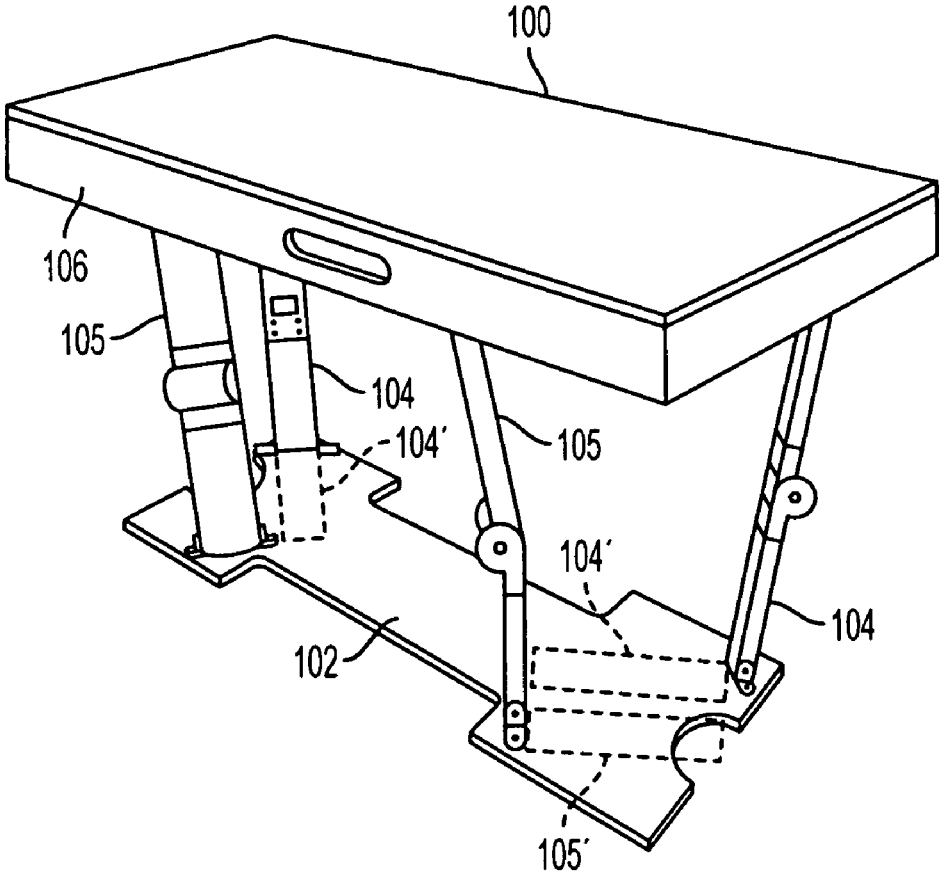
Figure 15:
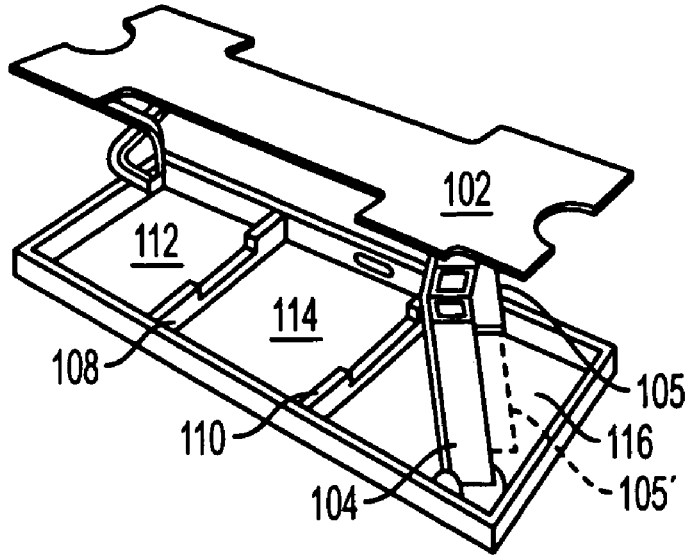
Figure 16:
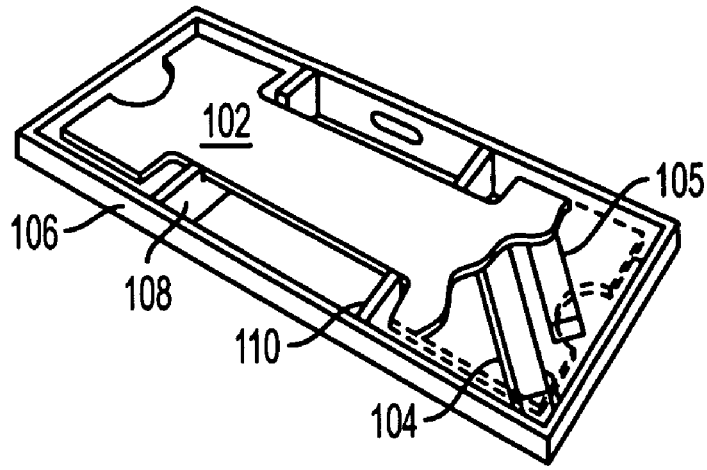

FIGS. 6*a* and 6*b* are a perspective views of a leg assembly with an alternative means of hinging and bracing the table leg at various pivoted positions;

FIGS. 7*a* and 7*b* are perspective views showing details of another alternative embodiment of the invention;

FIGS. 8*a,* 8*b* and 8*c* demonstrate a method of hinging and locking leg sections; and FIG. 9 is a perspective view showing an alternative embodiment of a hinging mechanism in accordance with the present invention;

FIG. 10 is a perspective view showing an alternative embodiment of a round top table having a one piece top member and a one piece base member according to the present invention;

FIGS. 11-13 are perspective views showing an alternative embodiment of a rectangular top table having a one piece top member and a one piece base member according to the present invention;

FIGS. 14-16 are perspective views showing an embodiment of a bench having a one piece top member and a one piece base member according to the present invention.

DETAILED DESCRIPTION OF PREFERRED EMBODIMENTS

As shown in FIGS. 1 and 2, an embodiment of the foldable table of this invention includes two top half sections 10 and 11 each of which is formal of a rectangular frame and a sheet of planar material affixed to the frame to form a table top surface. Hinges 12 and 13 (FIG. 2) are attached to sides 16 and 17 of the table top frames 14 and 15 so that the two top half sections and frames may pivot with respect to each within certain limits of rotation dictated by the configuration of the hinges and frames as follows:

Limit A represents the open state limit (FIGS. 1 and 2) where the adjacent sides 16 and 17 of frames 14 and 15 lay immediately adjacent to each other connected by hinges 12 and 13.

Limit B represents the closed state where all four edges of frames 14 and 15 lay against each other in an opposing manner (FIG. 3*d*).

Obviously, in the closed state (Limit B) the frames and top sheets of material form an encasement whereas in the open state (Limit A) the two top sections form a substantially flat table top. In FIGS. 1, 2 and 3 the frames 20 and 21 each traverse the perimeter of the respective top section, thereby forming a cavity or encasement when placed edge-to-edge (FIG. 3*d*.). In an alternative embodiment, the frame members could, in fact, only traverse one edge of each top sheet resulting in a folded structure like that shown in FIG. 8 when hinged together along the edges of the frame members.

Referring now to FIG. 2 notice that hinges 12 and 13 are distally disposed along the edges of sides 16 and 17 so that the hinges do not encumber the central portion along those edges. Also note that reliefs 18 and 19 are formed between the hinges by cutting away part of this central portion of sides 16 and 17. The reliefs 18 and 19 create clearance for receiving base unit sections 20 and 21, which base unit sections are pivotally joined by a hinge 22. The base unit is geometrically configured so that when the table is in its collapsed state (with the legs folded—see FIGS. 3*b* and 3*c*) the base unit may fit into the relief (18 and 19) so that hinge 22 aligns with hinges 12 and 13. Hinges 12, 13 and 22 then work in unison so that the table top and base unit fold simultaneously, with the folded base unit 20 and 21 encased between the top sections 10 and 11 (FIGS. 3*a*-3*d*). Obviously the geometric configuration of base unit assembly 22 and 23 demonstrate only one of many possible configuration and shapes that would fall within the scope of the invention.

Focusing now on FIGS. 1 and 2, note that the four foldable legs, each including of (at least) two leg section 23 and 24 that are pivotally connected together with hinges 25 so that the sections pivot diagonally inward toward the center of the table as the table collapses. In the embodiment of the invention shown in FIGS. 1, 2 and 3*a-d* hinges 25 are mounted on the outside surfaces of the leg sections in such a manner that the table legs may fold to a configuration where the two leg sections lay flatly together and unfold to a limit where the two leg section form a substantially straight table leg. It should be noted that alternatively the legs sections might be configured so that in the open unfolded state the two sections do not necessarily form a straight leg.

As will be discussed below, various well known hinging and bracing methods with leg sections to form bent table legs, or permit various degrees of bending to place the table at various heights. With respect to the first embodiment, it should be further noted that leg sections 23 and 24 likewise need not be of the same length and the base unit assembly 20 and 21 could be an amount smaller in size compared to top sections 10 and 11 such that the legs sections 23 and 24 slope or bend inward when the table is fully erected. Regarding the direction that the legs fold and the configuration of the legs, the straightness of the two sections, and the cross sectional configuration of the leg sections, numerous other configurations are contemplated that fall within the scope and spirit of this invention.

As to the leg sections 23 and 24, we see in FIGS. 1 and 2 that the end of each leg section 23 opposite hinge 25 is pivotally connected to the under side of a table top section with a hinge 26, while the opposing end of leg section 24 is pivotally connected to the table base unit 20, 21 with a hinge 27. It can now be appreciated that in the collapsed state (FIG. 3*d*) the folded legs will lay between the base units 20 and 21 and the table top sections 10 and 11, and it can be further appreciated that if the stacked thickness of the leg sections and base unit are equal to or less than the depth of the sides of frames 14 and 15, and with the base unit properly seated into reliefs 18 and 19, then the top sections 10 and 11 may be folded together with the folded base unit and legs encased between the top sections. Carrying handles could be added to the outside of frames 14 and 15 and buckles or similar latches could be used to keep the folded encasement closed.

FIGS. 1, 2 and 3*a-d* demonstrate one of the simplest forms of the invention using standard cabinet hinges 25, 26, and 27. Also shown in these figures are four scissor braces 28 that help to stabilize the legs when unfolded. Numerous other hinging methods and bracing methods could be employed, such as the methods disclosed in FIGS. 4, 5, and 6. It should be noted however, that the methods employed to stabilize and position each table leg is simplified and assisted by the fact that each leg is attached to base unit (20 and 21). The base unit serves the multiple purposes of helping to stabilize the leg, maintaining the integrity of the position of each leg, and simplifying the erecting of the table from the collapsed state.

In FIG, 3*d* a retractable handle is shown at 54 that may be conveniently used to carry the table assembly when it is in its closed or compacted configuration and is held in the configuration by recessed latches 55. Any suitable form of latch and carry handle may be used on any of the several embodiments disclosed herein.

FIG. 5*a* illustrates an alternative embodiment of the invention with a variation in the configuration of the legs and associated folding and hinging method. This embodiment erects into a table resembling a pedestal table. In FIG. 5*a* each leg assembly includes three folding sections 29, 30 and 31, which fold in either direction. FIGS. 4*a* and 4*b* demonstrate the folding sequence for each leg, which "Z" folds into the compact state. The hinging method for each section is somewhat similar to the method disclosed in FIGS. 6*a* and 6*b* except that its upper attachment points must slide from an inner, "deployed," position to an outer "retracted," position so as to accommodate the affect of the linkage end points (see FIG. 4*a*) when the sections are in the folded configuration. A notched slot or tract 39' similar to that shown at 39 in FIGS. 6*a* and 6*b* may be used.

Leg sections with a round cross section are used to further demonstrate variations of the invention. One unique feature of this configuration shown in FIG. 5*a* is that in the erect table state all of the central leg sections 30 forcibly meet at the central location creating a stable limitation for the otherwise collapsing table. Providing suitable clips, pins or latches for latching all four legs together eliminates the need for additional braces between the leg and the top sections. In addition, a cylindrical insert 57 having leg receiving slots 58 as shown in FIG. 5*b* might be interposed between the legs to raise the table height to an elevation higher than that illustrated in FIG. 5*a* as suggested by the dashed lines 29', 30' and 31' in FIG. 4*b*.

If slotted tracks 39' are not used to allow the upper ends of the legs to slide inwardly as the table is transitioned from its closed or compacted configuration to its open or extended configuration, and the upper leg ends are hingedly attached at a fixed position, it may be necessary to provide a frusto-conical spacer 59 or spreading mechanism as suggested in FIG. 5*d* to stabilize the legs.

To collapse the table, the legs must first be extended (forcing the top sections and base unit apart) then caused to pivot outward at the base unit. In addition, the upper leg end must be freed to move outwardly toward the corresponding table corner.

In FIGS. 6*a* and 6*b* an alternative hinging method is depicted along with an alternative bracing method that latches at various positions. The hinging method is comprised of a plurality of hinge plates 34 each with two apertures to receive hinge posts 35. The hinge posts or pins 35 also extend through the rounded ends of leg sections 32 and 33. This hinging method allows pivoting in two locations such that 33 can pivot relative to 34 and 34 can pivot relative to 32. This allows either leg section to pivot a total 180 degrees in either direction. One additional feature of this hinging method is that it nearly eliminates the possibility that hands, finger, or other objects could be caught or pinched between the ends of the leg sections. The conventional hinging method of FIGS. 1, 2 and 3*a-d* does not have this advantage.

Also shown in FIGS. 6*a* and 6*b* is a pivot pin or a brace 36 that is pivotally attached to leg section 32. At the opposite end of brace 36 is post 37 extending from brace 36 and through a slot 38 in bracket 39. The slot 38 is configured with a plurality of notches, which may receive post 37 to hold the leg in a selected position. As can be seen in the two figures, leg section 32 can be pivoted to various degrees where the post 37 coincides with one of the notches in slot 38. When the post is seated into a particular notch 38, the leg section 32 will remain in that relative position. This method of locking the position of leg section 32 could be employed to keep the collapsible table of this invention in one or more erect positions.

FIGS. 7*a* and 7*b* respectively illustrate perspective views showing details of another alternative embodiment of the invention from upper and lower angles. This embodiment is particular suited for manufacture from any of a variety of materials including wood, plastics and metals. As in previous embodiments it includes folding top surface forming members 11 and 12, folding base forming members 20 and 21, and a plurality of folding leg members 24. The top members and base members are hingedly joined together by hinges 13 and 22 respectively. The legs in this embodiment differ from the previous embodiments in that they are each comprised of four elongated elements 60-63. The upper ends of elements 60 and 61 are hingedly attached to the bottom of a top member by suitable hinges 65 while the lower ends thereof are pivotally connected to the upper ends of elements 62 and 63 by pivot pins 66. The lower ends of elements 62 and 63 are pivotally connected to a base member by a pivot pin 67. As will be appreciated, the table can be collapsed by folding it such that as the top members move toward the base, the base member folds into a nesting relationship with the lower leg elements 62 and 63 which in turn fold into a similar relationship with the upper leg elements 60 and 61 as the latter elements fold into place against the bottom surface of a top member. With the table so collapsed, the assembly can be folded into its compacted configuration by rotating the top members about the hinges 13 and the base members about the hinges 22.

This table design can easily be manufactured using solid wood on extruded tubular plastic or metal stock for the legs, top frame and base, and using sheet material to form the top surface. The several parts can be joined together as depicted using readily available hinges and pivot pin devices.

Figure 8B:
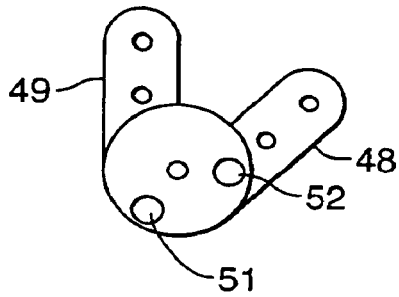
Figure 8C:
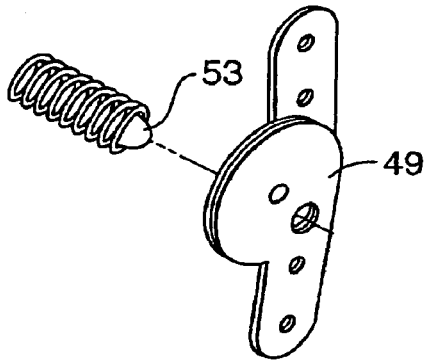

FIGS. 8*a*-8*c* demonstrates another alternative method of hinging and locking the table leg sections. Experimental models of the table have shown that a locking mechanism in the hinged connection between the table leg sections is all that is needed to stabilize and secure the table in its open position. As shown in these figures, the leg sections 46 and 47 and respective hinge plates 48 and 49 are pivotally connected by rivets 50. Aperture 51 in plate 49 and aperture 52 in plate 48 (FIG. 9*b*) will align when the hinge plates (and leg sections to which they are attached) are rotated to an open position, and there allow a spring loaded detent 53 to snap through both apertures thereby locking the legs in position. To release the hinge, the detent may be depressed until hinge plate 49 may rotate relative to 48. This type of locking mechanism is commonly used in other applications such as extension poles for tents and the like. The tip of the detent is rounded off to facilitate engaging and releasing actions.

FIG. 9 illustrates an alternative hinging and locking mechanism in accordance with the present invention. The hinge mechanism is similar in structure and function to that depicted in FIGS. 8*a*-8*c* and differs primarily in that instead of having side mounted, separate hinge plates that are affixed to opposite sides of the leg segments as shown above, this embodiment is pre-fabricated as a unit having first and second hinge parts 50 and 52 pivotally connected together by rivets or a single shaft 54. Each hinge part includes not only side plates corresponding to those of the FIGS. 8*a*-8*c* embodiment, but as shown, such elements are joined together by an integrally formed front plate 56 forming a leg receiving channel (as part 50 is shown broken away at the bottom of the figure), or by both front and back face plates 56 and 58 (as part 52 is shown broken away in the top part of the figure) that form a socket for receiving the adjacent ends of the leg segments 60 and 62. Prior to inserting the leg segment 62 into part 52, a transversely extending bore is provided in leg segment 62 proximate its end to receive a detent 64 and spring (not shown here, but such as is shown in FIG. 8*c*). The detent will extend into mating apertures 66 provided in the parts 50 and 52 to maintain the leg segments in their extended configuration as described above with respect to FIG. 8*a*. To unlock the legs so that they can be folded, detent 64 is pushed against the spring and out of the apertures 66 thus allowing hinge part 50 to rotate about pivot 54 and relative to part 52. The parts 50 and 52 are secured to the leg segments by a plurality of screws, nails or other fasteners 68.

FIG. 10 discloses yet another configuration of the invention wherein instead of the two part foldable top and base members previously described, an undivided top member 70 and an undivided base member 72 are joined by foldable leg assemblies 74 comprised of leg segments 76 and 78 foldably joined together by hinge assemblies 80 of the type depicted in FIG. 9 above. In this embodiment which is especially suited for use as an umbrella table, cocktail table or card table, etc., the top member 70 is oval (elliptical or circular) and the base member 72 is generally X-shaped.

Referring now to FIGS. 11-13, another embodiment of a table that is rectangular in form and having an undivided rectangular top member 82 and an undivided X-shaped base member 84 is depicted in its open configuration (FIG. 11) with its leg assemblies 86 in their extended or deployed configuration; in its transitioning configuration (FIG. 12); and in its collapsed or closed configuration (FIG. 13) with its leg assemblies 86 and base member 84 fully retracted and nested within the cavity formed by the frame 86 circumscribing top member 82. Note that in this embodiment a top stiffening rib 90 is provided beneath the top member 82 and divides the cavity therebeneath into two parts 92 and 94. In this case, the lengths of the folded leg assemblies are such that they extend at an angle across the bottom of the top member and nest within the subcavities on both sides of the rib 90. Note that, as perhaps best shown in FIG. 12, a notch 96 is provided in rib 90 providing relief from interference with and for receiving base 84.

In FIGS. 14-16, another embodiment of the invention particularly suited for use as a seat or bench is shown. In this case, the top member 100 is in the form of an elongated undivided rectangle, and the base member 102 is in the form of an elongated undivided X-shape. This embodiment is depicted in its open configuration (FIG. 14) with its leg assemblies 104, 105 in their extended or deployed configuration; in its transitioning configuration (FIG. 15) with its leg assemblies folding; and in its collapsed or closed configuration (FIG. 16) with its leg assemblies 104 and base member 102 fully retracted and nested within the multipart cavity formed by the frame 106 circumscribing top member 100 In FIG. 16 the base member 102 is shown partially broken to suggest how the folded leg assemblies 104 and 105 nest in parallel side-by-side relationship. Note that in this embodiment a pair of stiffening ribs 108 and 110 are provided beneath the top member 100 and divide the cavity therebeneath into three parts 112, 114 and 116.

This embodiment also differs from the previous embodiment in that the leg assemblies 104 on one side of the bench are positioned on the corners at the ends of the base member 102, and the leg assemblies 105 on the opposite side of the bench are positioned substantially inboard of the ends of the base member. In this case, the lengths of the folded leg assemblies are such that they extend at an angle across bottom of the top member and nest within the subcavities 112 and 116 at opposite ends of the top member. As suggested by the dashed lines 104' and 105' Note that, as perhaps best shown in FIG. 15, notches 109 111 are provided in ribs 108 and 110 providing relief from interference with and for receiving base 102.

The invention herein disclosed may be made of any suitable material (such as plastic, aluminum, steel, wood, etc.) and may be utilized in many ways (card table, display, desk, stool, outdoor table, etc.). Moreover, even though described above as including discrete hinge devices, it is contemplated that the table assembly could be fabricated by injection molding with at least some of the hingedly attached component parts joined together by integrally molded "living hinges."

Although the present invention has been described in terms of several alternative embodiments, it is anticipated that other alterations and modifications will become apparent to those skilled in the art after having read the above disclosure. It is therefore intended that such disclosure be considered illustrative and not limiting, and that the appended claims be interpreted to include all such alterations, modifications and embodiments as fall within the true spirit and scope of the invention.

What is claimed is:

1. A collapsible folding article of furniture, comprising:

a top member forming a generally planar top support surface;

a bottom member forming a base; and a plurality of foldable leg assemblies each including a set of at least two elongated leg sections pivotally attached together at adjacent ends by a hinge allowing the leg sections to be rotated between a folded configuration and an extended configuration, each said hinge having a first part attached to one of said leg sections and a second part attached to the other one of said leg sections, said first and second parts being pivotally secured together and having associated therewith a spring loaded detent carried by one of said legs for lockingly engaging a detent receiving aperture formed in one of said first and second parts affixed to the other leg, said detent and the aperture formed in said one part affixed to the other leg being positioned to be in locking alignment and engagement with each other when the leg assembly is in its extended configuration, one end of each leg assembly being pivotally attached to said top member and an opposite end of each leg assembly being pivotally attached to said base member, said leg assemblies allowing the top member to be collapsed from a deployed position remote from the bottom member to a retracted position proximate the bottom member.

2. A collapsible folding article of furniture as recited in claim 1 wherein said bottom member is generally X-shaped in configuration and one of said leg assemblies is attached to a distal portion of each leg of the X-shaped base.

3. A collapsible folding article of furniture as recited in claim 2 wherein said top member and said bottom member have a length substantially longer than their width, and wherein the separation between the leg assemblies on one side of the longer dimension is substantially shorter than the separation between the leg assemblies on the other side of the longer dimension.

4. A collapsible folding article of furniture as recited in claim 3 wherein said article of furniture is a seating bench, and the leg assemblies at each end fold into a volume of space equal to approximately one third of the volume defined by the space separating said top and bottom members when said top and bottom members are in said retracted position.

5. A collapsible folding article of furniture as recited in claim 2 wherein the leg assemblies at opposite corners of said top and bottom members fold along parallel lines that intersect a longitudinal centerline of said top and bottom members.

6. A collapsible folding article of furniture as recited in claim 5 wherein said top member and said bottom member have a length substantially longer than their width, and wherein the separation between the leg assemblies on one side of the longer dimension is substantially shorter than the separation between the leg assemblies on the other side of the longer dimension.

7. A collapsible folding article of furniture as recited in claim 5 wherein said top member is oval in shape.

8. A collapsible folding article of furniture as recited in claim 1 wherein said top member and said bottom member have a length substantially longer than their width, and wherein the separation between the leg assemblies on one side of the longer dimension is substantially shorter than the separation between the leg assemblies on the other side of the longer dimension.

9. A collapsible folding article of furniture as recited in claim 8 wherein the leg assemblies at each end of the longer dimension of said top and bottom members fold along parallel lines that intersect a longitudinal centerline extending along the longer dimension of said top and bottom members.

10. A collapsible folding article of furniture as recited in claim 8 wherein the leg assemblies at each end of the longer dimension of said top and bottom members fold along parallel lines that intersect a centerline of one orthogonal dimension of said top and bottom members.

11. A collapsible folding article of furniture as recited in claim 1 wherein said top member has a polygonal shape, and said bottom member is generally X-shaped in configuration.

12. A collapsible folding article of furniture as recited in claim 1 wherein said leg assemblies are made of extruded plastic material.

13. A collapsible folding article of furniture as recited in claim 1 wherein said leg assemblies are made of wood.

14. A collapsible folding article of furniture as recited in claim 1 wherein said leg assemblies are made of tubular material.

15. A collapsible folding article of furniture as recited in claim 1 wherein said leg assemblies are made of metal.

16. A collapsible folding article of furniture as recited in claim 1 wherein said first and second parts of said hinge assemblies each include a left side plate and a right side plate joined together by an integrally formed front plate, the three plates forming a channel for receiving an end portion of one of said leg sections.

17. A collapsible folding article of furniture as recited in claim 1 wherein said first and second parts of said hinge assemblies each include a left side plate and a right side plate joined together by integrally formed front and rear plates, the four plates forming a socket for receiving an end portion of one of said leg sections.

* * * * *